US008083532B1

(12) United States Patent
Nicholson et al.

(10) Patent No.: US 8,083,532 B1
(45) Date of Patent: Dec. 27, 2011

(54) ELECTRICAL CONTACT WITH EASY RELEASE

(76) Inventors: Rufus Andrew Nicholson, Trophy Club, TX (US); Perry Xavier Weston, Trophy Club, TX (US)

( * ) Notice: Subject to any disclaimer, the term of this patent is extended or adjusted under 35 U.S.C. 154(b) by 0 days.

(21) Appl. No.: 12/932,638

(22) Filed: Mar. 2, 2011

Related U.S. Application Data

(60) Provisional application No. 61/340,882, filed on Mar. 25, 2010.

(51) Int. Cl.
*H01R 13/62* (2006.01)

(52) U.S. Cl. ..... 439/180; 439/352

(58) Field of Classification Search ..... 439/180, 439/346, 352, 353, 373, 857
See application file for complete search history.

(56) References Cited

U.S. PATENT DOCUMENTS

| | | | |
|---|---|---|---|
| 1,341,468 | A | 5/1920 | Kenney |
| 2,262,272 | A | 11/1941 | Eaton |
| 3,643,202 | A | 2/1972 | Coon |
| 4,867,697 | A | 9/1989 | Borges |
| 5,145,393 | A | 9/1992 | Schoon |
| 7,393,212 | B2 | 7/2008 | Parker |

*Primary Examiner* — Khiem Nguyen

(57) ABSTRACT

A female contact comprising two opposing elongated blades pivotally connected defining a gap there between to receive a male prong, the blades having at least one angularly directed extension resiliently engaging a shaped surface configured to regulate restraining forces on a male prong during insertion, retention and extraction from the gap, thereby self activating an abrupt release of the prong in response to a predetermined extraction force applied in a substantial range of lateral angles.

10 Claims, 4 Drawing Sheets

ELECTRICAL CONTACT WITH EASY RELEASE

CROSS REFERENCE TO RELATED APPLICATIONS

This application claims the benefit of provisional application Ser. No. 61/340,882 filed 2010 Mar. 25 by the present inventors.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

FIELD OF THE INVENTION

The present invention relates to separable electrical connectors constituted of a socket member and a plug member and, more particularly, to the contacts of female sockets.

BACKGROUND

Separable connectors are universally employed for electrical connections in residential and commercial buildings. Typically a standard male plug from an electrical product is inserted into the female socket. The contacts in the socket largely determine the force required to extract the plug.

Contacts with inadequate pressure can let the male plug work away from the face of the socket thereby allowing small objects to fall onto the prongs of the male plug. Light pulling forces on the cord may result in partial extraction and the user can accidentally touch the prongs and experience electric shock. Ultimately, an inadvertent pulling force may completely release the plug and terminate power to the electrical product.

Sockets with contacts that tightly retain a power plug can hurt people. Tight power cords connected to multiple items of portable electronic equipment in hospital rooms frequently cause tripping injuries to patients and staff. There is associated damage when equipment is pulled off a shelf or otherwise upset. Occasionally instruments are dragged from a mobile cart by inadvertent movement. The problem is amplified in operating rooms where managing the number of power cords is increasingly difficult. Intravenous pumps, monitors and the like used during lengthy surgery add multiple connections to facility power. There are corresponding difficulties in homes and businesses, including appliances where follow through from a hard pull can drive a person's hand into a nearby object, or when a tight plug has to be tediously worked back and forth to disengage it from the receptacle. Furthermore, operators frequently pull on the power cord to disconnect a plug that is out of reach, obscured or otherwise difficult to remove. Such a pull against tight contacts incurs a high risk of breaking the wire inside the cord.

Considerations in design of a contact to reduce the risks discussed above include ensuring that the optimum contact pressures established in manufacture are maintained during the life of the contact, and that the optimum release pressures are maintained for plug extraction when pulls on the cord are at angles substantially away from normal to the face of the socket.

Double wipes are a type of contact predominately found in conventional wiring devices such as wall receptacles, socket adapters, power strips, extension cords and the like which typically do not maintain a constant release force over time. Numerous conventional double wipe contact clips have their opposing blades interconnected in various ways such as riveting, staking and welding. A rivet or weld tends to deform or creep over a period of time, resulting in subsequent failure of the contact members to maintain proper contact pressure. Also, the conventional devices often do not adequately prevent separation between the contact blades when the male prong is inserted, leading to stresses that exceed the yield point of the material forming the contact. Increasing blade length helps in decreasing the bending stresses but usually it is not possible to increase the blade lengths because there are various constraints imposed on maximum blade length in conventional devices.

Many connectors are known which provide a high contact pressure and a light extraction force by utilizing a manually releasable self-locking mechanism. A manually actuated easy release however, is not effective when immediate plug separation is needed to prevent injury or damage. An operator is not likely to be near the receptacle, nor would he have time to take the release action.

Known receptacles typically suffer from other disadvantages related to safety risks:

(1) A plug may only be partially inserted by a careless operator, (2) a plug can work its way out when subjected to inadvertent pulls less than required to extract the plug, (3) vibration at the receptacle can loosen a plug, and (4) the male plug may only be extracted with a pulling force substantially normal to the face of the socket.

SUMMARY

A female contact is designed to be mounted into an insulated contact pod of an electrical wiring device. In one aspect according to an embodiment, the female contact comprises a pair of elongated metal blades arranged as planar members having opposing faces pivotally connected. A gap formed at the forward end of the blades receives a male prong. The distant end of the blades has angularly directed extensions for engagement with a separate shaped member to rotate the blades against the male prong. A separate resilient member having a spring portion urges wiping surfaces on the extensions against wiping surfaces on the shaped member. The spring portion thereby indirectly acts in applying side pressure on the male prong inserted into the gap.

The wiping surfaces engage at angles configured to resist longitudinal movement of the blades toward the shaped member while amplifying side pressures on the male prong being inserted. The angles of engagement are further configured to aid longitudinal movement of the blades away from the shaped member while relaxing side pressure on the male prong being extracted. When insertion pressure is reached, the resilient member may suddenly deflect causing the contact to abruptly accept the male prong and apply a retention pressure, and then, upon application of at least a predetermined pulling force on the male prong, the resilient member further deflects to reduce the side pressure to a value lower than required for retention of the male prong, and the female contact abruptly releases the male prong.

As will be apparent, the contact may be formed from a single sheet of material of appropriate composition by shearing and bending operations. Assembly is substantially limited to installing the blades into a slot extending from one end of the resilient member, so the contact is relatively easy and inexpensive to manufacture.

ADVANTAGES

Accordingly several advantages of one or more aspects are as follows: to provide electrical connectors that reliably release a plug at the lowest extraction force limit, that release the plug at substantial lateral cord pull angles, that provide feedback to the operator when the plug reaches full insertion, that act to prohibit partial insertion and extraction of the plug, that accept standard conventional plugs, that can be used with plugs having different nominal blade thicknesses, that can be easily manufactured, that maintain the optimum contact pressures established in manufacture, and that require no special installation or use procedures.

The contact works not only for easy release but also may be used in a broad range of electrical wiring devices with different insertion and extraction forces. Electrical devices utilizing the contact may have the same form, fit and user interface as existing conventional electrical devices. For instance, a user will plug equipment into a receptacle the same as always. Nothing new has to be learned. Improved receptacles may appear the same as conventional devices and install the same way into existing outlet boxes. Furthermore, the receptacles may be designed to accommodate safe and convenient installation by homeowners who are not electricians and have little experience and background in electrical matters. To this end electrical receptacles may still be equipped with both screw terminals and back-wire push-in (BWPI) terminals where the bared ends of solid wire line and neutral conductors are inserted through back openings in the receptacle case. The advantage of an operator not requiring any new knowledge, thoughts, actions or parts makes use of the electrical wiring devices having the contact transparent over the use of existing conventional devices.

Other advantages of one or more aspects will be apparent from consideration of the drawings and ensuing description.

DETAILED DESCRIPTION OF THE EMBODIMENTS

Reference Listing

| | | | |
|---|---|---|---|
| 100' | contact | 102' | male plug |
| 110' | resilient member | 120 | spring |
| 130 | stationary member | 140 | opening |
| 150 | first elongated contact blade | 150a | second elongated contact blade |
| 160 | protuberance | 170 | diverging lip |
| 180 | tab | 190 | plate |
| 200 | pivot point | 210 | first angularly directed extension |
| 210a | second angularly directed extension | 220 | shaped member |
| 230 | hole | 240 | slot |
| 250 | protrusion | 260 | groove |
| 270 | face | 280 | conventional screw |

Referring generally to FIGS. 1-9; an electrical contact with easy release includes a contact generally designated 100', that possesses at least a pair of elongated blades with a gap there between for the reception of a male prong and a resilient member in communication with the pair to regulate restraining forces on the male prong during insertion, retention and extraction from the gap.

Figure 1:
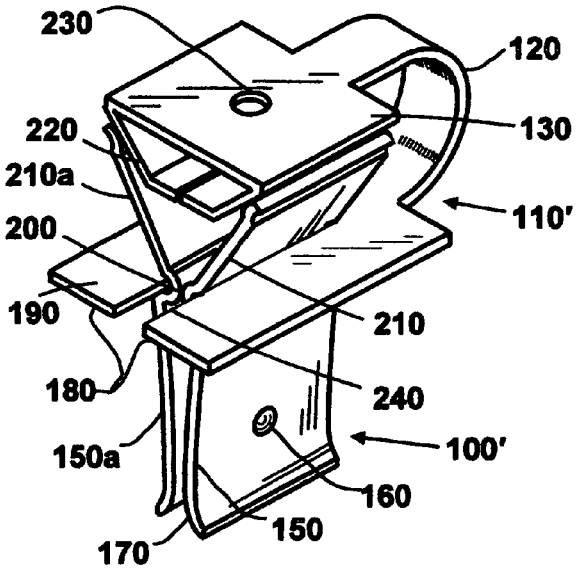
FIG. 1 shows a perspective view of one embodiment which possesses a contact having a flat resilient member formed into an arch.
Figure 2:
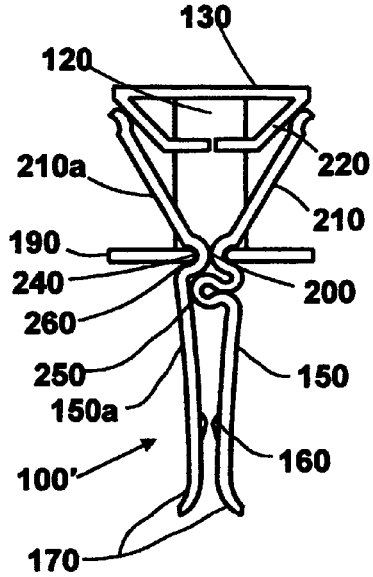
FIG. 2 shows an end view of the contact of (FIG. 1).

FIGS. 1 and 2 show respectively, a perspective view of contact 100', and an end view according to one embodiment. Contact 100' is designed to be inserted into an area, cavity, pocket or pod of an electrical wiring device assembly, not shown, and is formed from suitable material such as brass or brass alloy comprising metal strips having good electrical conductivity and a suitable spring rate. It will be understood that conventional wiring device assemblies commonly have a housing with plurality of contact pods arranged to receive similarly disposed multi pronged male contacts extending from one end of a mating plug. Contact 100' shown in FIG. 1 can be incorporated into the contact pods of various electrical devices, including but not limited to plug receptacles of wall sockets, socket adapters, power strips, extension cords and the like. Contact 100' can be formed from a single plate of metal by conventional metal shearing and bending operations, the plate of metal having a nominal thickness related to the current-carrying rating of the contact. Contact 100' includes a first elongated contact blade 150 and an opposing second elongated contact blade **150*a* having opposing faces pivotally connected, and arranged as a pair of planar members having respectively a first angularly directed extension 210 and a second angularly directed extension 210*a*. A resilient member 110' to urges extensions 210 and 210*a* to engage a shaped member 220 for the purpose of controlling rotation of blades 150 and 150*a* relative to each other. Resilient member 110' may be configured with a bias to hold the elements of contact 100' substantially in a predetermined alignment when no male prong is inserted. A male prong which is to be inserted between blades 150 and 150*a*** may be of a pin or straight blade type, or preferably a locking blade type having locking notches or depressions on either or both sides of the blade, or more preferably the standard type having a ⅛ inch diameter hole near the end of the blade.

Blades 150 and **150*a* have forward ends with a width dimension substantially equal to the maximum width of the male prong they receive, and distant ends possessing a pivot point 200 with a pivot axis aligned substantially parallel to the faces of blades 150 and 150***a* and substantially perpendicular to the length of blades 150 and 150*a*. The forward ends of blades 150 and 150*a* are free and may be bent outwardly to form a diverging lip 170 for guiding the male prong between blades 150 and 150*a*. At least one protuberance 160 can be on the face of one of blades 150 and 150*a* and aligned with a similarly disposed protuberance 160 on the opposing face of the other of blades 150 and 150*a*. Protuberances 160 at their inward most points define the minimum gap between blades 150 and 150*a*. Protuberances 160, if used, may be aligned so they engage the locking depression or hole on the male prong, and may be tapered to facilitate insertion and removal of the male prong. Extending inwardly at a point on blades 150 and 150*a* beyond the depth of an inserted male prong can be a protrusion 250, preferably comprising a fold in the side of one or both of blades 150 and 150*a*. If blades 150 and 150*a* include this inward protrusion 250, the inward most point of protrusion 250 defines the minimum spacing between the faces of blades 150 and 150*a*. This minimum spacing may be slightly less than the nominal thickness of the range of sizes of male prongs to be received. Blades 150 and 150*a* may comprise a slightly arcuate shape so as to achieve the optimum blade contact with the sides of the male prongs for the range of sizes of male prongs to be received. The closer the area of blade contact is to the pivot axis located at pivot point 200, the greater the side pressure is on the male prong.

Resilient member 110' has a deflectable section and a fixed section. The deflectable section may be mechanically referenced to blades 150 and 150*a* and may be attached to blades 150 and 150*a* substantially at pivot point 200, or may be configured for use in holding blades 150 and 150*a* aligned at pivot point 200. The fixed section of resilient member 110' may be mechanically fixed relative to shaped member 220. While a folded flat spring 120 is shown as part of resilient member 110' in FIG. 1, it is intended to be merely exemplary and spring 120 can be a straight flat spring, bent flat spring, or any other type of spring including but not limited to a torsion spring, a coil spring or a wire spring. The deflectable section of a wire spring may be extended to be the hinge pin in the case of a pivot point comprising a pin attachment. Resilient member 110' is not intended to be limited to a single metallic spring but can include a plurality of springs or a resilient plastic material such as a sponge or flexible composite which may be molded into or be part of an electrical wiring device.

A stationary member 130 can be mechanically fixed relative to shaped member 220 and can include a planar base as an expansion of the fixed section of spring 120, and may be disposed to attach to the housing of an electrical wiring device. Stationary member 130 may include a single contact or preferably two contacts connected to the same or common voltage or more preferably, a contact set comprising a plurality of contacts in the electrical wiring device which are connected to the same or common voltage, and may be fixed in position with respect to the housing of the electrical wiring device so that each of the comprised contacts 100' is positioned as required for placement within its designated contact pod. Stationary member 130 may be mounted in the fixed position by conventional mechanical attachments including, but not limited to, fasteners such as screws, bolts, nuts, studs and rivets; or may be clamped with an attached clamp; or clamped between mating surfaces of the wiring device or against the mating surfaces; or stationary member 130 may be enlarged and shaped to be mounted using slots and shoulders formed in the wiring device housing. Stationary member 130 may contain a hole(s) 230 for use with a fastener in mounting the member in the electrical wiring device.

Blades 150 and 150*a* could be retained at pivot point 200 by an interlocking arrangement, preferably by an arrangement which may be secured with a pin as in a pin hinge, or more preferably by a clamp comprising a slot 240 in a plate 190, wherein blades 150 and 150*a* are inserted into slot 240. Plate 190 may be an extension of spring 120 having a free end comprising an opening for slot 240. Slot 240 has a width dimension which may be substantially equal to, or slightly larger than the combined thickness of blades 150 and 150*a* to allow clearance for blades 150 and 150*a* to rotate with respect to each other. Slot 240 has a length dimension which may be sufficient for retention of blades 150 and 150*a*, or preferably may correspond to the width of blades 150 and 150*a*, or more preferably may be further extended to form tabs 180 on plate 190 at the opening of slot 240. The edges of slot 240 along the length in contact with blades 150 and 150*a* may be rounded to form a bearing surface against which blades 150 and 150*a* can rotate. The length, width and thickness of plate 190 are constrained by the dimensions of the contact pod, not shown, into which contact 100' is to be installed, and are determined considering the length of slot 240 and forces encountered during insertion of the male prong so that the yield point of the metal composition forming slot 240 is not exceeded. If the yield point of the metal is exceeded, slot 240 will be permanently distorted and subsequently may not provide for the desired spring deflection and contact pressures. Blades 150 and 150*a* may be prevented from sliding inadvertently in slot 240 by closing the outer end of slot 240, or preferably by cutting and bending or otherwise forming tabs 180 to block the movement, or more preferably by configuring a projection in slot 240 to confine blades 150 and 150*a* to their proper position, blades 150 and 150*a* being disposed to cooperate with the projection, or most preferably by using a surface in the contact pod in the electrical wiring device to confine blades 150 and 150*a* to proper position in slot 240. Resilient member 110' could be connected to any location on plate 190 or could connect to a plurality of locations on plate 190.

Referring once again to FIG. 2, blades 150 and 150*a* may be aligned in slot 240 using a groove 260 across the width of each blade 150 and 150*a*. Grove 260 located substantially at pivot point 200 may be formed by a rounded fold in the metal of blades 150 and 150*a*. The rounded fold may comprise a half circle, the arc of which may be reduced slightly to accommodate the necessary angular rotation about the edges of slot 240 which are in contact with groove 260. The radius of the inner surface of groove 260 can be any size, preferably between ½ and 1 times the thickness of plate 190, or more preferably a radius selected based on the shape of the contacting edges of slot 240. The outer surface of grove 260 comprises a bearing surface on the faces of blades 150 and 150*a* against which blades 150 and 150*a* rotate at pivot point 200.

Extensions 210 and 210*a* may extend from the vicinity of pivot point 200 outwardly directed at any angle with an absolute value between 0 degrees and 180 degrees from a straight extension in the planes of blades 150 and 150*a*, or preferably in a range between 0 and 90 or 90 and 180 degrees, or more preferably between 10 and 70 or 100 and 160 degrees, or most preferably between 15 and 25 or 125 and 145 degrees. The angle and form of extensions 210 and 210*a* are configured to achieve the desired ratio of side pressure on an inserted male prong to the deflection force against resilient member 110' while considering the angle of engagement with shaped member 220. Extensions 210 and 210*a* may be any width but preferably substantially the same width as blades 150 and

150*a*, and may be any length except as constrained by contact spacing and electrical wiring device dimensions. Extensions 210 and 210*a* may comprise outward ends with wiping surfaces that slide against shaped member 220. The wiping surfaces may be, but not limited to, a ridge across the width of extensions 210 and 210*a*, a rolled edge, a protuberance, or an even surface. The wiping surfaces of extensions 210 and 210*a* may have at least one projection, depression, groove, ridge, edge or other feature configured to cooperate with shaped member 220 in keeping the wiping surfaces and blades 150 and 150*a* properly positioned. The widths of blades 150 and 150*a* and extensions 210 and 210*a* may be trimmed or tapered as required to prevent undesired interference with any surface in the contact pod in the electrical wiring device, not shown.

Shaped member 220 comprises any metal such as bronze or may be any non-conductive material such as a suitable thermoplastic. Shaped member 220 may comprise an extension of stationary member 130 contoured to provide the desired angle of engagement with extensions 210 and 210*a* during insertion, retention and removal of the male prong, or may be formed and contoured as a separate member attached or preferably molded to the electrical wiring device housing or otherwise fixed relative to the fixed section of resilient member 110'. Two sides of shaped member 220 that engage extensions 210 and 210*a* comprise fixed wiping surfaces that may or may not be symmetrical with each other. Shaped member 220 may or may not extend across the width of extensions 210 and 210*a*, and may wipe against any location across the width of extensions 210 and 210*a*, but preferably near the center. The wiping surface of shaped member 220 may be, but not limited to a protuberance, or a ridge, or a rolled edge, or a flat surface, or a narrow strip slightly relieved from the flat surface. Shaped member 220 may be further constrained in size and shape to cooperate with the wiping surface and positioning features of the engaged extensions 210 and 210*a*, and to be compatible with the wiring device contact pod.

Contacts 100' may be constrained to certain maximum length dimensions by the depth of the wiring device contact pods into which they are mounted, including an allowance for forward movement of contacts 100' as a result of deflection of spring 120, or by various regulations relating to the standardization of wiring contact dimensions. Certain other size and placement dimensions of the electrical wiring device contact pods may impose additional constraints on the geometry of contacts 100', including but not limited to shifting the plane of extensions 210 and 210*a* relative to the plane of blades 150 and 150*a*.

Figure 3:
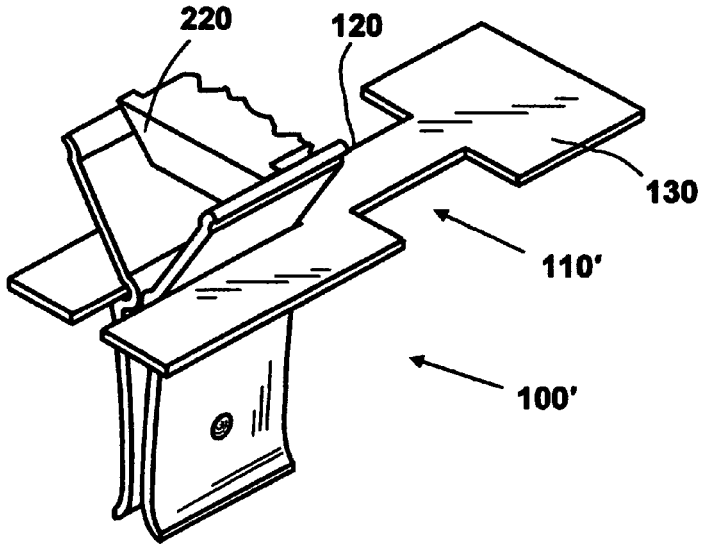
FIG. 3 depicts another embodiment possessing a contact having a straight resilient member.

FIG. 3 shows a perspective view of contact 100' comprising a spring 120 that can be straight, flat and joined to stationary member 130, and a separate shaped member 220 which may be attached to, or be part of the electrical wiring device housing so that it may be fixed in position relative to stationary member 130.

Figure 4:
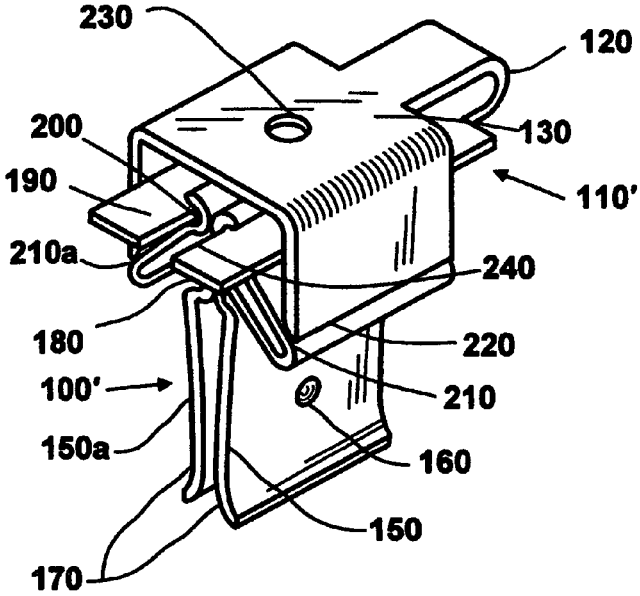
FIG. 4 depicts another embodiment of the contact possessing blade extensions at an angle greater than 90 degrees from the longitudinal plane of the blade.
Figure 5:
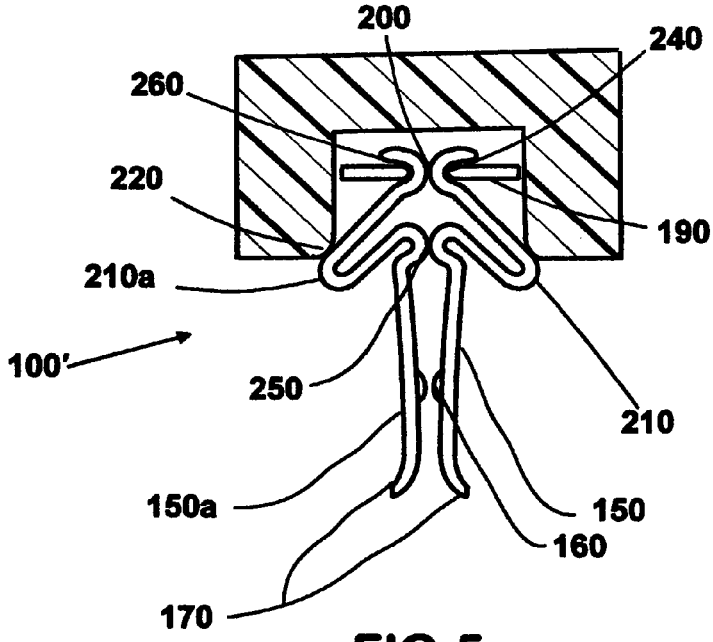
FIG. 5 shows an end view of an embodiment possessing a contact having blade extensions at an angle greater than 90 degrees from the longitudinal plane of the blade, and a straight flat spring.

FIG. 4 shows a perspective view of contact 100' in which extensions 210 and 210*a* extend from the vicinity of pivot point 200 at an angle with an absolute value in a range between 90 and 180 degrees, while FIG. 5 shows an end view of a similar contact using a straight flat spring 120 and a separate shaped member 220. Extensions 210 and 210*a* at the greater angle range may reduce the contact pod space necessary for shaped member 220.

Figure 6:
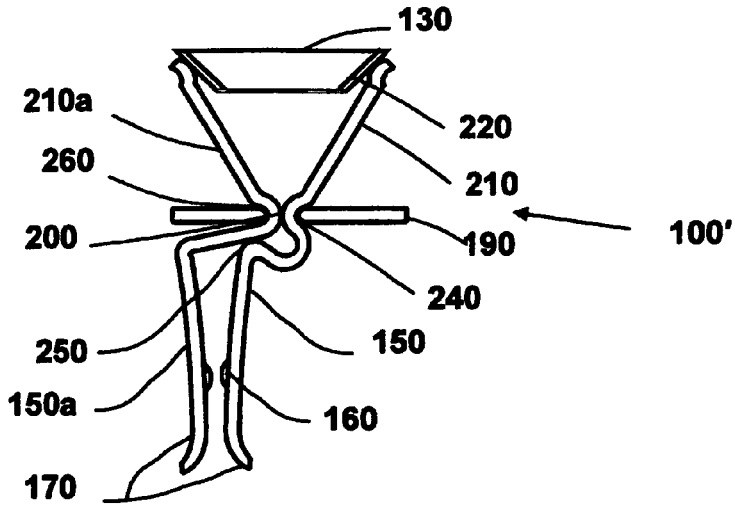
FIG. 6 shows an end view of an embodiment possessing a contact having the longitudinal plane of the blades shifted from the plane of the blade extensions.
Figure 7:
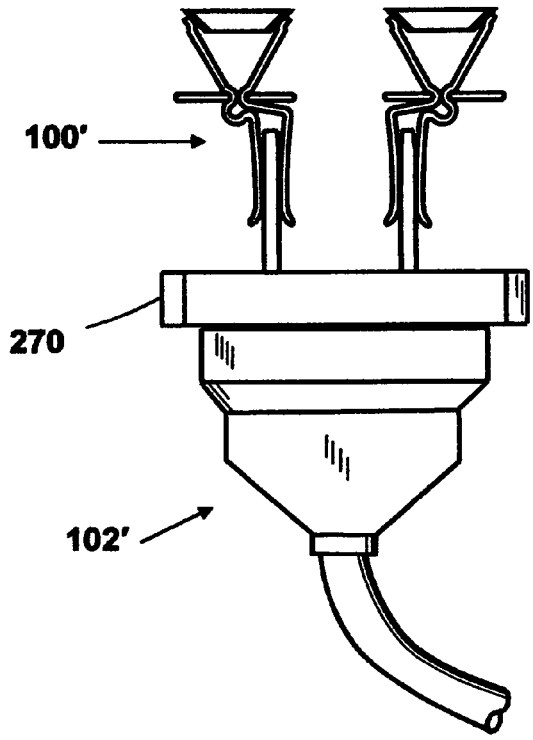
FIG. 7 shows a male plug with two prongs plugged into a pair of contacts.

FIG. 6 depicts another example of how contact 100' might be adapted to constraints imposed by the geometry of electrical wiring device contact pods. The end view shows opposing members 150 and 150*a* shifted to the left of extensions 210 and 210*a*. The shape of protrusion 250 requires modification in order to accommodate the shift. This type of adaptation might be needed where there is substantial internal wiring device structure between the openings of an outlet face. FIG. 7 shows conceptually how a pair of contacts 100' located behind an outlet face 270 of an electrical wiring device could receive the prongs of a male plug generally designated 102' plugged into face 270.

Figure 8:
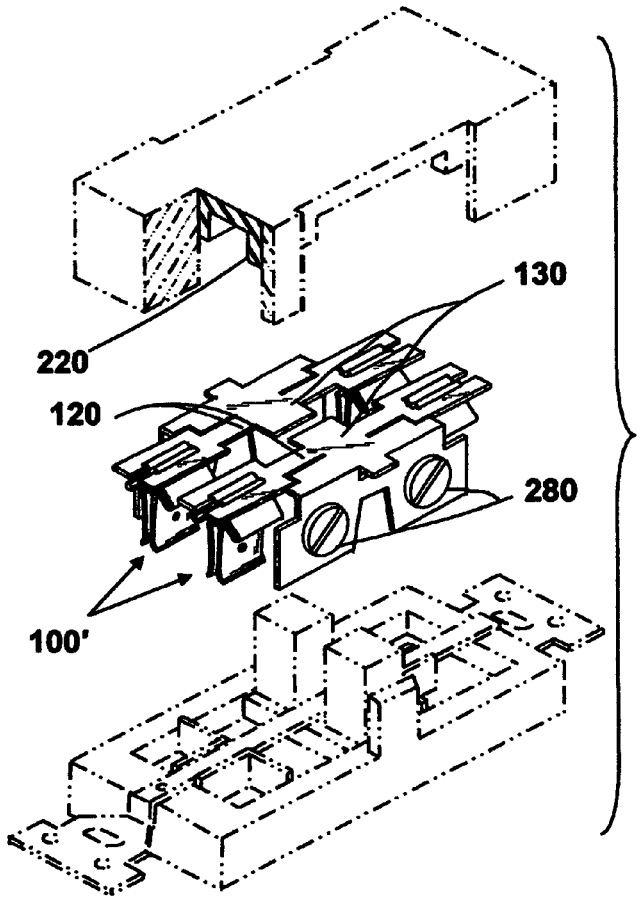
FIG. 8 shows an example of contact sets installed into an electrical wiring device.

FIG. 8 comprises a contact assembly showing an example of contacts 100' installed in an electrical wiring device. The perspective view is of two contacts 100' each comprising one stationary member 130 utilizing two straight flat springs 120. Stationary members 130 are shaped to be compatible generally with a duplex electrical wiring device and may have provisions for one or more conventional screws 280, each for attachment of an electrical cord. A conventional duplex electrical wiring device housing is shown in exploded view to indicate how the illustrated contacts 100' could be inserted. The items shown in broken line are not part of the claimed invention. Separate shaped members 220 are shown in the cutaway and may be molded into or attached to the wiring device housing. Should an electrical wiring device require more than two sockets as in an outlet strip, stationary members 130 in the example could be extended to form a longer row.

Figure 9:
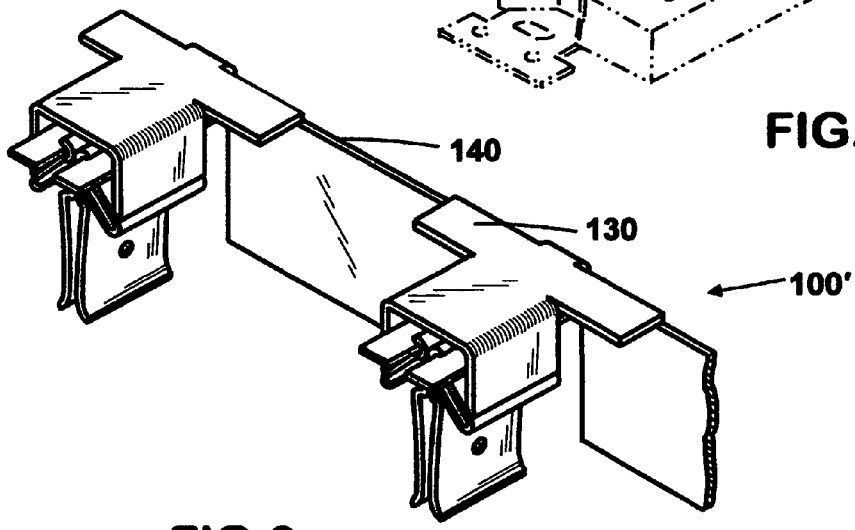
FIG. 9 shows an example of contacts with blades oriented at right angles to the length of an electrical wiring device.

FIG. 9 shows an example of a stationary member 130 that could be used in receptacles which receive blades having widths oriented at right angles to the length of the electrical wiring device. An opening 140 provides space for fitment of an opposing stationary member 130, not shown, connected to a different voltage than the shown stationary member 130.

Referring again to FIG. 1, the contact may be assembled as two contacts 100' with opposing ends facing and connected using a bridge extending from stationary members 130. The same type of assembly may also apply to contact 100' shown in FIG. 4.

EXAMPLE OF USE

The following description of use is intended as merely exemplary and it is conceivable that other uses encompassed by the disclosure as a whole may present themselves to one of skill in the art.

Blades 150 and 150*a* when driven outwardly by insertion of the male prong will rotate about pivot point 200, forcing extensions 210 and 210*a* to simultaneously engage shaped member 220 in a manner urging spring 120 to deflect. The wiping surfaces engage at angles to resist longitudinal movement of blades 150 and 150*a* toward shaped member 220 while amplifying side pressures on the male prong being inserted, and further configured to aid longitudinal movement of blades 150 and 150*a* away from shaped member 220 while relaxing side pressure on the male prong being extracted. Spring 120 deflection acts to apply force in two directions, directly to apply tension on blades 150 and 150*a* in the direction opposing extraction, and indirectly through rotation of extensions 210 and 210*a* to apply amplified side pressure on the male prong. When insertion pressure is reached, spring 120 suddenly deflects causing contact 100' to abruptly accept the male prong and apply a retention pressure, and then, upon application of at least a predetermined pulling force on the male prong, spring 120 further deflects to reduce the side pressure to a value lower than required for retention of the male prong, and contact 100' abruptly releases the male prong. A uniformly deflected spring 120 indirectly applying pressure helps compensate for the effects of contact wear so removal force should remain predictably stable over the life of the contact.

Direct spring action serves to hold the male prong in the fully inserted position following any pull insufficient to completely extract the prong. Release depends very little on overcoming contact friction. Most of the pull is just to deflect spring 120. A male prong that is not fully accepted will not be retained at all and may fall away from blades 150 and 150*a*.

Side pressures and release forces on the male prong are controlled by the spring rate of spring 120, the bias on spring 120, the form of blades 150 and 150*a*, the shape of protuberance 160, the form of extensions 210 and 210*a*, the form of shaped member 220, and the angle of engagement between the wiping surfaces of extensions 210 and 210*a* and the wiping surfaces of shaped member 220. Higher side pressures at insertion result in good contact wiping action. Maximum insertion force may be limited by the spring rate of blades 150 and 150*a*. The spring rate is the ratio of the force applied vs. the deflection at the point of application of the force, which in contact 100' would be primarily applied at pivot point 200.

The force to release a male plug from an electrical socket having contacts 100' is substantially equal for straight pulls and for cord pulls at substantial lateral angles from normal to the face of the socket. The side force component of a lateral cord pull tends to rotate the plug out of the socket. The resulting angular translation of the male prongs will force the end of a male prong into the face of one of blades 150 or 150*a*. The engaged blade then moves about pivot point 200, deflecting spring 120 to release the male prong while applying a component of force against the end of the male prong in the direction of extraction. Extensions 210 and 210*a* continue to engage shaped member 220 thereby tending to keep blades 150 and 150*a* substantially aligned with the blade openings in the face of the socket. Limited longitudinal displacement between blades 150 and 150*a* may be permitted by movement in slot 240. The movement in slot 240 and some torsional deflection of spring 120 may also be factors in keeping blades 150 and 150*a* aligned with the blade openings. Blades 150 and 150*a* and extensions 210 and 210*a* are resilient and may deflect at larger lateral pull angles to aid in release of the male prong. Should cord pull be relaxed before sufficient force is applied to release the plug, spring 120 acts in a direction to reposition blades 150 and 150*a* against the male prong and rotate the plug back into the socket. Release for pulls beyond substantially 40 degrees off center may be constrained by the width and shape of the blade openings in the face of a conventional electrical socket.

Electrical power may be supplied to contacts 100' in various ways including but not limited to an electrical cord comprised of a single conductor or a plurality of substantially parallel or twisted electrical conductors sheathed together in a jacket of electrical insulating composition. The cord may be mechanically attached directly to one or both blades 150 and 150*a*, or preferably attached to conductive shaped member 220 for conduction through extensions 210 and 210*a* to blades 150 and 150*a*, or more preferably attached to plate 190 or other extension of the deflected section of spring 120 for conduction through pivot point 200 to blades 150 and 150*a*, or most preferably attached to stationary member 130 which may be electrically attached to the fixed section of resilient member 110' and shaped member 220. Stationary member 130 or other extensions from the fixed section of resilient member 110' are predominantly the members used for attaching contact 100' to the electrical wiring device housing.

The force required to disengage the mating connector may be increased by adding an obstruction device, not shown, in the contact pod to restrict deflection of spring 120. The device may be, but not limited to, a mechanical device to interfere with deflection of spring 120, such as a wedge or an adjustable opposing spring, or preferably an adjustable bar to engage tabs 180 or outer end of plate 190.

Contact 100' could also be used to accept the grounding pin of a multi pronged plug. There are existing techniques for mating with the ground pin which contribute relatively little to plug removal force but these do not necessarily release at off axis pull angles.

Although the foregoing description contains many specificities, these should not be construed as limiting the scope of the embodiments but as merely providing illustrations of some of several embodiments. For example the stationary member could be of a number of sizes and shapes to cooperate with the electrical wiring device, the contact pod in the electrical wiring device could be customized to provide attachment points or restraining fixtures for inhibiting deflection of certain resilient elements, additional mounting provisions could be configured on the contact, adaptations could be added to accept a grounding pin or other pins, the contact could also be used as a power switch contact accepting a knife blade, the shaped member could become the deflected member with the blades referenced to the housing for operation in an easy insertion mode, The plug could also be released by pulls off axis longitudinally by providing clearance around the edges of the blades, a micro switch could be added for actuation against a deflected member to control an indicator or power disconnect, wiping surfaces could be altered with a suitable material such as a polymer to change the coefficient of friction. The wiping surfaces could be configured with a detent to restrict wiping motion until a predetermined deflection force on the spring is achieved, and further contoured with a shoulder to restrict inward movement of the blades. Accordingly, the scope should be determined not by the embodiments illustrated, but by the appended claims and their equivalents.

We claim:

1. A female electrical contact, comprising:

1) at least one pair of elongated blades comprising opposing planar members having opposing faces pivotally connected, the blades having a gap there between into which a male prong can be inserted to make electrical contact with the blades, and further, the blades having at least one extension with a wiping surface; and, 2) a shaped member having at least one fixed wiping surface to engage the wiping surface of the at least one extension at least one predetermined angle; and, 3) a resilient member including a deflectable section and a fixed section in communication with the deflectable section, one section being mechanically referenced to the blades, and the other section being mechanically fixed relative to the shaped member; and further, the resilient member being configured to urge the extensions into increasing contact with the shaped member resulting in increased side pressure on the male prong being inserted into the contact;

whereby upon insertion of the male prong into the gap between the blades, the female electrical contact suddenly accepts the male prong when full insertion pressure is reached, and then, upon application of substantially a predetermined extraction force to the male prong, the female electrical contact abruptly releases the male prong.

2. The female electrical contact according to claim 1 in which the resilient member is disposed to deflect in a direction opposing insertion of the male prong, and to deflect further in the same direction when extraction force is exerted on the male prong.

3. The female electrical contact according to claim 1 in which the shaped member is in communication with the fixed section of the resilient member.

4. In an electrical wiring device assembly having a housing comprising a plurality of insulated contact pods, at least one female electrical contact comprising:

1) at least a pair of elongated blades comprising opposing planar members having opposing faces pivotally connected, the blades having a gap there between into which a male prong can be inserted to make electrical contact with the blades, and further the blades having at least one extension with a wiping surface; and, 2) a shaped member having at least one fixed wiping surface to engage the wiping surface of the at least one extension at least one predetermined angle; and, 3) a resilient member including a deflectable section, and a fixed section in communication with the deflectable section, one section being mechanically referenced to the blades, and the other section being mechanically fixed relative to the shaped member; and further, the resilient member being configured to urge the extensions into increasing contact with the shaped member resulting in increased side pressure on the male prong being inserted;

whereby upon insertion of a male prong, the electrical wiring device suddenly accepts the male prong when full insertion pressure is reached, and then, upon application of substantially a predetermined extraction force to the male prong, the electrical wiring device abruptly releases the male prong.

5. In an electrical wiring device according to claim 4 in which the shaped member of the at least one contact is part of its respective contact pod.

6. In an electrical wiring device according to claim 4 further comprising a plurality of stationary members attached to the housing, each mechanically fixed relative to a corresponding shaped member.

7. In an electrical wiring device according to claim 6 in which the stationary members corresponding to contacts having a common voltage are rigidly bussed together comprising a unitary stationary member from which more than one contact can be positioned as required for placement within its designated contact pod.

8. In an electrical wiring device according to claim 4 further comprising an obstruction in each contact pod to restrict deflection of the spring to not more than required for the range of sizes of male prongs to be received.

9. In an electrical wiring device according to claim 4 in which the shaped member is mechanically fixed relative to the wiring device housing and the blades are free to deflect.

10. In an electrical wiring device according to claim 4 in which the blades are mechanically fixed relative to the wiring device housing and the shaped member is free to deflect.

* * * * *